US007952289B2

(12) United States Patent
Bretmersky et al.

(10) Patent No.: US 7,952,289 B2
(45) Date of Patent: May 31, 2011

(54) UV LAMP SYSTEM AND ASSOCIATED METHOD WITH IMPROVED MAGNETRON CONTROL

(75) Inventors: Carl A. Bretmersky, North Olmsted, OH (US); James W. Schmitkons, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 698 days.

(21) Appl. No.: 11/962,698

(22) Filed: Dec. 21, 2007

(65) Prior Publication Data

US 2009/0160345 A1 Jun. 25, 2009

(51) Int. Cl.
*H01J 25/50* (2006.01)
*H05B 39/00* (2006.01)

(52) U.S. Cl. ..... 315/39.51; 315/149

(58) Field of Classification Search ..... 315/39.51, 315/106, 307, 150, 160, 149, 151, 156–158
See application file for complete search history.

(56) References Cited

U.S. PATENT DOCUMENTS

| | | | | |
|---|---|---|---|---|
| 4,441,002 | A * | 4/1984 | Teich et al. | 219/708 |
| 5,760,544 | A * | 6/1998 | Taniguchi et al. | 315/39.51 |
| 6,265,830 | B1 * | 7/2001 | Bretmersky et al. | 315/106 |
| 6,952,082 | B2 * | 10/2005 | Schmitkons et al. | 315/149 |
| 7,166,963 | B2 * | 1/2007 | Janos et al. | 313/634 |
| 2006/0289508 | A1 * | 12/2006 | Kim | 219/714 |
| 2007/0031281 | A1 * | 2/2007 | Stevens | 422/24 |

* cited by examiner

*Primary Examiner* — Douglas W Owens
*Assistant Examiner* — Minh D A
(74) *Attorney, Agent, or Firm* — Wood, Herron & Evans, L.L.P.

(57) ABSTRACT

An ultraviolet lamp system for irradiating a substrate includes a magnetron and a memory physically attached to the magnetron. An electrodeless lamp is configured to emit ultraviolet light when excited by microwave energy generated from the magnetron. Main control circuitry is operable to read and write operational data associated with the magnetron to the memory. The ultraviolet lamp system is operated by generating microwave energy from the magnetron. A plasma within an electrodeless lamp is excited with the microwave energy to emit ultraviolet light. Operational data associated with the magnetron is tracked and written to the memory associated with the magnetron.

13 Claims, 4 Drawing Sheets

UV LAMP SYSTEM AND ASSOCIATED METHOD WITH IMPROVED MAGNETRON CONTROL

FIELD OF THE INVENTION

The present invention relates generally to ultraviolet lamp systems and, more particularly, to maintaining historical operational data for ultraviolet lamps.

BACKGROUND OF THE INVENTION

Ultraviolet ("UV") lamp systems are commonly used for heating and curing materials such as adhesives, sealants, inks, and coatings. Ultraviolet lamp systems operate by exciting an electrodeless plasma lamp with microwave energy. The electrodeless lamp is mounted within a metallic microwave cavity or chamber. One or more microwave generators, such as magnetrons, are coupled via waveguides with the interior of the microwave chamber. The magnetrons supply microwave energy to initiate and sustain a plasma from a gas mixture enclosed in the electrodeless lamp. The plasma emits a characteristic spectrum of electromagnetic radiation strongly weighted with spectral lines or photons having ultraviolet and infrared wavelengths.

Magnetrons used in the UV lamp systems are consumable items with their life determined by a number of factors, including total hours of operation, number of starts, time in a standby mode, power level, as well as other conditions. Predicting when a magnetron will fail or reach the end of its life requires knowledge of its operation history. In addition to providing a better prediction of end of life, the history can also be used to verify warranty claims, provide better information for failure analysis, and improve magnetron life by adjusting the operating parameters.

SUMMARY OF THE INVENTION

An ultraviolet lamp system is provided which includes a magnetron and a memory physically attached to the magnetron. An electrodeless lamp is configured to emit ultraviolet light when excited by microwave energy generated from the magnetron. Main control circuitry in the lamp system is operable to read and write operational data associated with the magnetron to the memory. The memory includes a non-volatile computer memory chip attached to the magnetron in some embodiments.

In other embodiments, the ultraviolet lamp system includes an intermediate control circuit in electrical communication with the main control circuitry and in electrical communication with the memory. The main control circuitry is configured to track operational data for the magnetron and communicate with the intermediate control circuit to provide tracked operational data thereto. The intermediate control circuit is operable to read and write operational data to and from the memory. The intermediate control circuit communicates with the main control circuitry using a CAN protocol.

In another embodiment, the ultraviolet lamp system includes a second magnetron. The main control circuitry for this embodiment is operable to write operational data associated with the first magnetron and the second magnetron to the memory.

Operational data includes filament use hours, actual hours under power, number of power on/off cycles, time in a standby mode, initial power level of the magnetron, output power level of the magnetron, and combinations thereof.

The ultraviolet lamp system is operated by generating microwave energy from the magnetron, which excites a plasma within an electrodeless lamp to emit ultraviolet light. Operational data associated with the magnetron is tracked and written to a memory associated with the magnetron. The operational data associated with the magnetron may also be read from the memory.

In some embodiments, an operating parameter of the magnetron is adjusted based on the operational data read from the memory. In other embodiments an end of life for the magnetron is predicted from the operational data read from the memory and a recommendation that the magnetron be replaced is made in response to the magnetron being near the predicted end of life.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION

Figure 1:
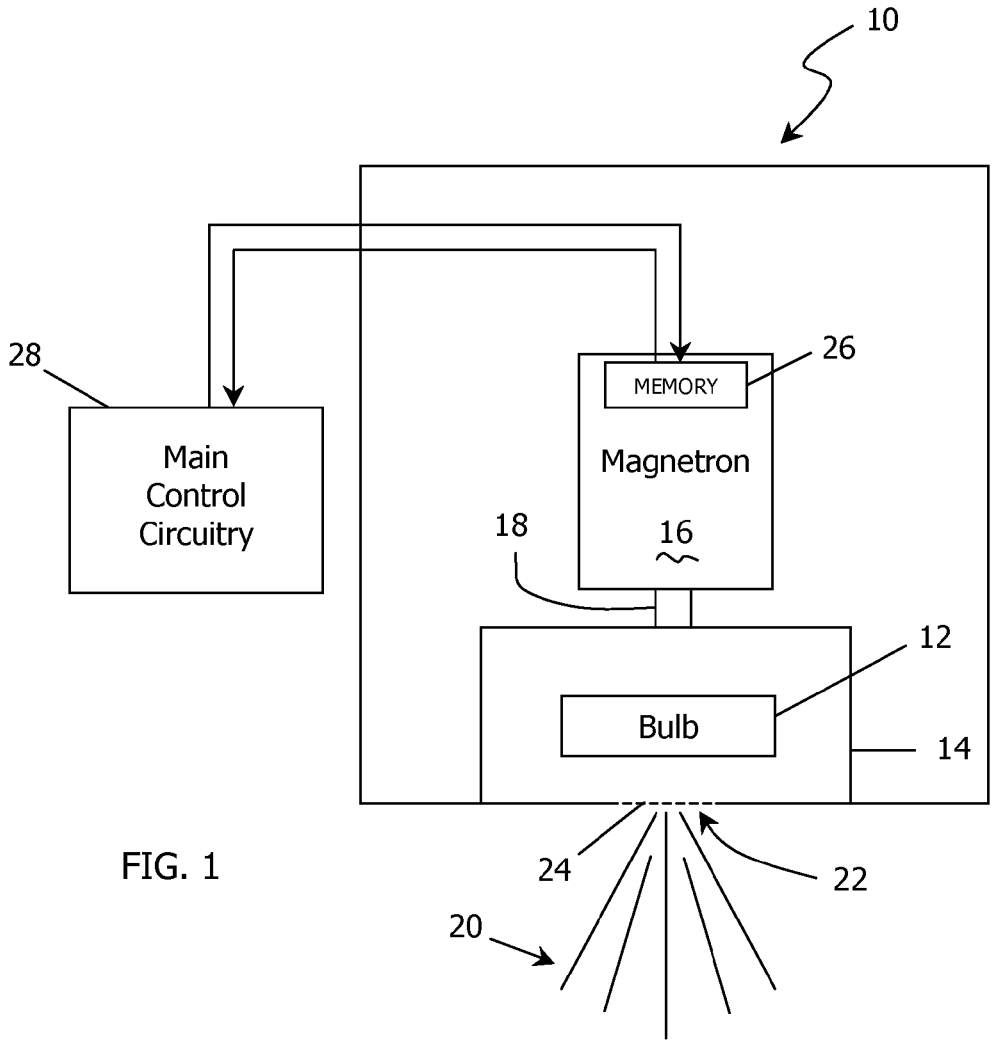
FIG. 1 is a block diagram of an ultraviolet lamp system including a magnetron with a memory.

Referring now to the drawings, FIG. 1 is a block diagram of an ultraviolet lamp system 10 that relies upon excitation of an electrodeless lamp 12 with microwave energy. The electrodeless lamp 12 is mounted within a metallic microwave chamber 14. A magnetron 16 is coupled via waveguide 18 with the interior of the microwave chamber 14. The magnetron 16 supplies microwave energy to the electrodeless lamp 12 in order to generate ultraviolet light 20. The ultraviolet light 20 is directed from the microwave chamber 14 through a chamber outlet 22 to an external location through a fine-meshed metal screen 24 which covers the chamber outlet 22 and is capable of blocking emission of microwave energy, while allowing the ultraviolet light 20 to be transmitted outside the microwave chamber 14.

A memory 26 is physically attached to the magnetron 16 and is configured to store operational data related to the magnetron 16. The operational data associated with the ultraviolet lamp system 10 is generally tracked and stored by main control circuitry 28, which is typically associated with the power supply. The main control circuitry 28, however, does not generally track when magnetrons 16 are replaced, and thus any operational data associated with a specific magnetron 16 may be lost. The memory 26 is in electrical communication with the main control circuitry 28. The main control circuitry 28 is operable to periodically write operational data related to the magnetron 16 to provide a history of the use of the magnetron 16. Because the memory 26 is attached to the magnetron 16, this history is retained with the magnetron 16. The magnetron history may then be used in conjunction with, for example, warranty and failure matters of the magnetron 16.

Figure 2:
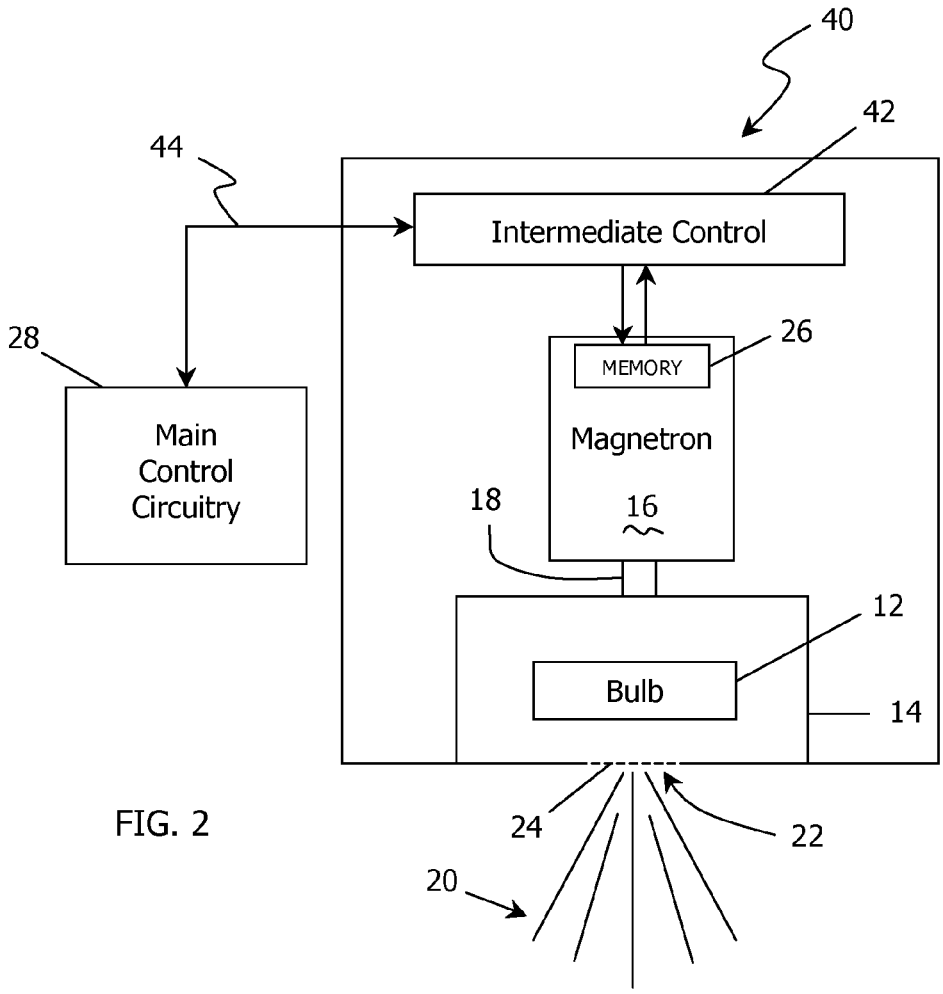
FIG. 2. is a block diagram of an alternate embodiment of the ultraviolet lamp system including a magnetron with a memory.

In an alternate embodiment of the ultraviolet lamp system 40 illustrated in FIG. 2, an intermediate control circuit 42 may be used in conjunction with the memory 26 on the magnetron 16. The intermediate control circuit 42 is in electrical communication with both the main control circuitry 28 and the memory on the magnetron 16. In addition to facilitating the connection of the main control circuitry 28 to the memory 26, the intermediate control circuitry 42 may also be operable to track additional operational parameters not currently tracked by the main control circuitry 28 or may track operational parameters in place of the main control circuitry 28.

The main control circuitry 28 is located in the power supply enclosure (not shown), which is connected to the lamp head by a multi-conductor cable. The multi-conductor cable may be up to approximately 100 feet in length. To minimize the number of conductors in the cable and to ensure reliable signals, the intermediate control circuit 42 and main control circuitry 28 communicate using a digital link 44 such as the CAN protocol, although other communications protocols may be used for other embodiments. All of the operational parameters from the main control circuitry 28 are sent over the digital link 44 to the intermediate control circuit 42, which then writes them to the memory 26 on the magnetron 16.

In some embodiments, as described above, tracking the operational data may be divided between the main control circuitry 28 and the intermediate control circuit 42, where, for example, the main control circuitry 28 tracks the actual number of filament use hours, while the intermediate control circuit 42 tracks the output power levels of the magnetron 16. The main control circuitry 28 would then communicate the tracked filament use hours to the intermediate control circuit 42, which in turn would store the filament use hours in the memory 26.

Figure 3:
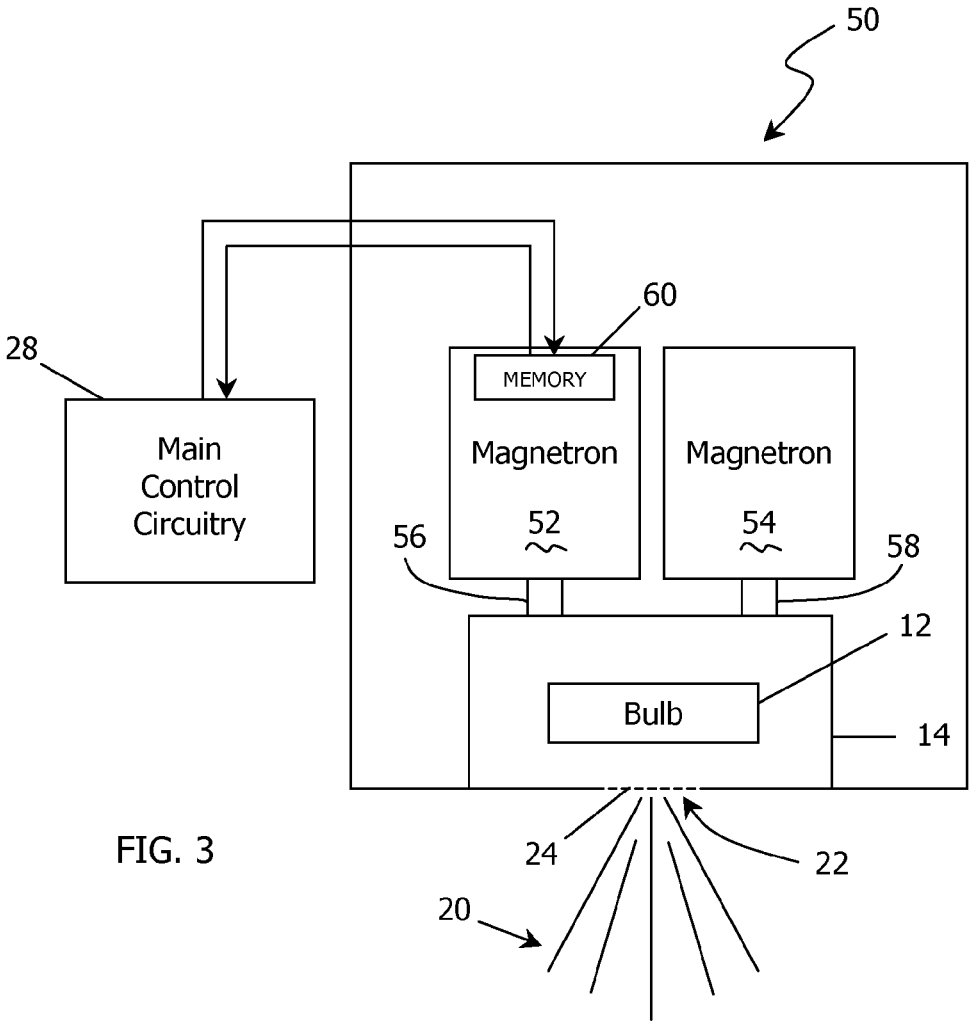
FIG. 3 is a block diagram of an embodiment of the ultraviolet lamp system including two magnetrons with a memory.

Other embodiments of the ultraviolet lamp system 10 may include additional magnetrons and potentially additional memories attached to those magnetrons. For example, an embodiment of the ultraviolet lamp system 50 in FIG. 3 is a system requiring a pair of magnetrons 52, 54. These magnetrons 52, 54 are coupled via waveguides 56, 58 to the interior of the chamber 14. A memory 60 is physically attached to one of the two magnetrons 52, 54 and tracks the operational data for both magnetrons 52, 54. A single memory 60 may be used for this embodiment, because the magnetrons 52, 54 will always be installed and/or replaced in pairs. In still other embodiments having multiple magnetrons, each magnetron may have its own memory.

Referring again to FIG. 1, the historical data stored in the memory 26 of the magnetron 16 may be used for multiple purposes. For example, the end of life of a magnetron 16 is fairly predictable if the number of hours of operation of the magnetron 16 is known. This historical data could be used to prevent a failure by predicting the end of life and then displaying a message to an operator on the power supply display recommending that the magnetron 16 should be replaced before a failure occurs. Additionally, if the ultraviolet lamp system 10 predicts that the magnetron 16 is near the end of its life, the ultraviolet lamp system 10 may increase the current to the filament, for example, to assist in prolonging the life of the magnetron 16.

Similarly, data could be obtained and analyzed to determine the number of hours that the magnetron 16 is in use, either actively or in a stand-by mode. In a stand-by mode, the magnetron's filaments are heated, but the lamp 12 is not lit. Other data that may be useful to both the lamp system owner and manufacturer could include the number of hours the filament is heated, the number of on/off power cycles, initial power level of the magnetron 16, and output power levels of the magnetron 16.

For example, the above-mentioned data can be used to validate warranty claims or issues. If a magnetron is returned after a few hundred hours of use for prematurely failing, the data stored in the memory 26 associated with the magnetron 16 can be analyzed to determine the cause of the failure. Based on the data, the failure may be a genuine failure of the magnetron 16 and a warranty would cover the replacement. Alternatively, the magnetron 16 may have been left in standby (filament power applied) for thousands of hours, causing the magnetron 16 to fail because it reached its end of life, not because of an inherent problem with the device.

The memory 26 could also be used in conjunction with a new magnetron 16 by initially storing an output power level associated with the new magnetron when it is shipped to a customer. Specifications on the output power for some magnetrons range from approximately 2.8 kW to approximately 3.2 kW. The output power data stored in the memory 26 can be used to adjust the power settings when the magnetron 16 is installed so that 100% output power would be equivalent the lower limit of approximately 2.8 kW. For example, in the two-magnetron configuration of the ultraviolet lamp system 50 in FIG. 3, magnetron 52 may have an output power rating of 2.8 kW and magnetron 54 may have an output power rating of 3.1 kW. The main control circuitry 26 would read the output power ratings of the two magnetrons 52, 54 from the memory 60 and adjust the input power of magnetron 54 such that its maximum output would not exceed the 2.8 kW of magnetron 52.

Because the magnetrons 52, 54 are consumable items, they will be replaced many times over the useful life of the lamp system 50. For some critical applications, the UV intensity and exposure time are determined during process development of the application. Deviation in the UV intensity (which is proportional to the output power of the magnetron) can cause the process to fail to meet specifications. This typically would occur each time the pair of magnetrons 52, 54 is replaced, requiring the "process" to be manually adjusted to obtain the desired results. By reading the operational data containing the output power characteristics of the magnetrons 52, 54 from the memory 60, the main control circuitry 28 can automatically adjust the maximum output power to the magnetrons 52, 54 to approximately 2.8 kW to continue to produce consistent output levels of the ultraviolet lamp system 50, eliminating the need for any manual re-adjustments to the "process".

Figure 4:
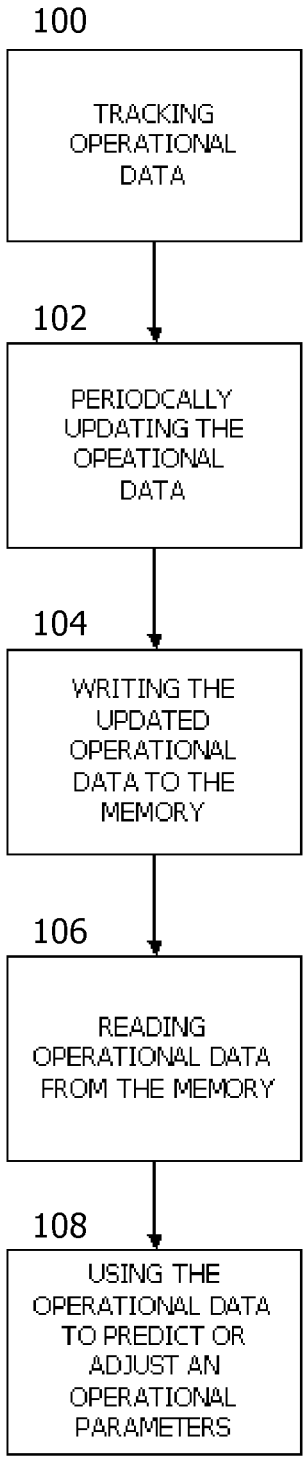
FIG. 4 is a flowchart showing a method to store operational data in the memory of the ultraviolet lamp systems of FIG. 1.

Referring now to the flowchart in FIG. 4, the operational data associated with the magnetron is tracked in block 100. The operational data is periodically updated in block 102, and then written to the memory in block 104. Once the operational data is stored in the memory, it can be read in block 106 to be used either during the operation of the lamp system, in conjunction with warranty claims as described above, or for other purposes. If the operational data is read during the operation of the lamp, it can be used to predict or adjust other operational parameters in block 108, such as predicting the end of life of the magnetron or adjusting the filament current of the magnetron as described above.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. An ultraviolet lamp system for irradiating a substrate, comprising:

a magnetron;

an electrodeless lamp configured to emit ultraviolet light when excited by microwave energy generated from said magnetron;

a memory physically attached to said magnetron; and main control circuitry in electrical communication with said memory, said main control circuitry operable to write operational data associated with said magnetron to said memory.

2. The ultraviolet lamp system of claim 1 wherein said main control circuitry is further operable to read operational data from said memory.

3. The ultraviolet lamp system of claim 1 further comprising:

an intermediate control circuit in electrical communication with said main control circuitry and in electrical communication with said memory, wherein said main control circuitry is configured to track operational data for said magnetron and communicate with said intermediate control circuit to provide tracked operational data thereto.

4. The ultraviolet lamp system of claim 3 wherein said intermediate control circuit is operable to read and write operational data to and from said memory.

5. The ultraviolet lamp system of claim 3 wherein said intermediate control circuit communicates with said main control circuitry using a CAN protocol.

6. The ultraviolet lamp system of claim 1 wherein said magnetron is a first magnetron, the ultraviolet lamp system further comprising:

a second magnetron, wherein said main control circuitry is operable to write operational data associated with said first magnetron and said second magnetron to said memory.

7. The ultraviolet lamp system of claim 1 wherein said operational data is selected from the group consisting of filament use hours, actual hours under power, number of power on/off cycles, time in a standby mode, initial power level of said magnetron, output power level of said magnetron, and combinations thereof.

8. A method of operating an ultraviolet lamp system comprising:

generating microwave energy from a magnetron;

exciting a plasma within an electrodeless lamp with the microwave energy to emit ultraviolet light;

tracking operational data associated with the magnetron; and writing the operational data to a memory physically attached to the magnetron.

9. The method of claim 8 wherein the operational data is selected from the group consisting of filament use hours, actual hours under power, number of power on/off cycles, time in a standby mode, initial power level of the magnetron, output power level of the magnetron, and combinations thereof.

10. The method of claim 8 further comprising:

reading the operational data associated with the magnetron from the memory.

11. The method of claim 10 further comprising:

adjusting an operating parameter of the magnetron based on the operational data read from the memory.

12. The method of claim 11 wherein the operational data is an initial power level of the magnetron, and adjusting the operating parameter comprises:

adjusting an output power percentage of the magnetron based on the initial power level in order to provide a consistent power output.

13. The method of claim 10 further comprising:

predicting an end of life for the magnetron from the operational data read from the memory; and in response to being near the predicted end of life, recommending that the magnetron be replaced.

* * * * *